US005558077A

United States Patent [19]

Linsmeyer

[11] Patent Number: 5,558,077

[45] Date of Patent: Sep. 24, 1996

[54] BOW STRING RELEASE WITH BEARD GUARD

[75] Inventor: Louis R. Linsmeyer, Hutisford, Wis.

[73] Assignee: Tru-Fire Corporation, Fond du Lac, Wis.

[21] Appl. No.: 285,800

[22] Filed: Aug. 4, 1994

Related U.S. Application Data

[63] Continuation-in-part of Ser. No. 979,106, Nov. 20, 1992, Pat. No. 5,357,939.

[51] Int. Cl.[6] ..... F41B 5/18

[52] U.S. Cl. ..... 124/35.2

[58] Field of Search ..... 124/35.2

[56] References Cited

U.S. PATENT DOCUMENTS

| | | | |
|---|---|---|---|
| 3,948,243 | 4/1976 | Gazzara | 124/35.2 |
| 4,282,851 | 8/1981 | Lyons | 124/35.2 |
| 4,574,767 | 3/1986 | Gazzara | 124/35.2 |
| 4,620,523 | 11/1986 | Peck | 124/35.2 |
| 5,370,102 | 12/1994 | Peck | 124/35.2 |

*Primary Examiner*—John A. Ricci
*Attorney, Agent, or Firm*—Robert C. Curfiss; Butler & Binion, L.L.P.

[57] ABSTRACT

The bow string release includes a trigger mechanism which may be selectively operated in a push to fire or pull to fire manner. The sear mechanism in the release is adapted to pivot relative to the release body without the use of spherical bearing elements. The pull force of the trigger is adjustable in a direction orthogonal to the trigger travel. The release also includes a beard guard to minimize the tendency of a beard or hair from being caught in the release mechanism during firing.

3 Claims, 5 Drawing Sheets

BOW STRING RELEASE WITH BEARD GUARD

CROSS REFERENCE TO RELATED APPLICATION

This application is a continuation-in-part of the earlier filed application Ser. No. 07/979,106, filed on Nov. 20, 1992 and now issued as U.S. Pat. No. 5,357,939.

BACKGROUND OF INVENTION

1. Field of Invention

The invention is generally related to bow string releases and is specifically directed to a release having a reversible trigger.

2. Description of the Prior Art

Bow string releases are well known in the industry. Typically, a bow string release is designed to engage and lock a bow string in a mechanical sear for allowing the archer to pull the bow to its maximum draw. A trigger mechanism is then used to unlock the sear mechanism and release the string to fire the arrow.

There are numerous; sear mechanisms available ranging from ball type releases as shown in U.S. Pat. No. 4,403,584 entitled: Bow String Release, issued to Todd on Sep. 13, 1983, and U.S. Pat. No. 4,476,845 entitled: Archery Bowstring Releasing Device, issued to Rickard on Oct. 16, 1984 to various jaw-type releases which have been available for many years. Each of the bow string release mechanisms utilizes a trigger release in order to disengage the sear or permitting the string to be released for firing the arrow.

Typically, trigger mechanisms operate in one of two configurations. The first configuration is generally defined as a thumb or forward release type trigger, wherein the bow string is held in the forefingers, with the release in the palm of the hand and the trigger mechanism facing upwardly. When the thumb is pressed forward against the trigger, the sear is opened and the jaws are released for releasing the string. In the second configuration, the trigger mechanism operates in much the same manner as a firearm trigger, with the release being held in the palm of the hand and the trigger being disposed behind the index finger, wherein the release is unlocked when the trigger is squeezed by the index finger in a rearward direction, in the same manner as firing a pistol, rifle or other firearm. The particular trigger configuration selected is primarily a matter of choice. Some archers prefer the thumb-type or forward motion trigger whereas many others prefer the firearm-type or reverse motion trigger.

To date, there are no string release mechanisms which permit the archer to select a forward or reverse motion from a single mechanism. It would be desirable to provide such a mechanism since this would permit the archer to experiment with both types of trigger mechanisms without the expense of buying a plurality of bow string releases. Also, it would greatly enhance manufacturability of the string releases, permitting a single trigger mechanism be utilized for either a forward motion or a reverse motion string release.

The No. R-63 Quick-Silver Release offered by Martin Archery, Inc. in Walla Walla, Wash., as illustrated in Archery Business, August/September 1988 issue, includes a jaw action sear for closing and opening the string retaining notches. In most cases, a bearing element is positioned between the two jaws approximately in alignment with the pivot points thereof. The bearing element assures smooth, low friction action of the jaws as they are moved from the closed to the open position, assuring a good true line for the fired arrow. Many of these releases are self-closing with the string being placed in the space between the jaws and into the notch, after which it engages a closure abutment for locking the jaw in the closed position. The jaw is then not opened for releasing the string until the trigger mechanism is activated.

While there have been many advances in the string release art over the last several years, there are known no releases with dual action reverse and forward motion triggers. Finally, the jaws have not been substantially altered over the years, with most having a narrow opening for receiving the string and relying on a bearing element between the jaws adjacent to the pivot points in order to assure smooth firing. While these jaws have been acceptable from a functional standpoint, the addition of the bearing element greatly increases the cost of manufacture.

Therefore, there remains a need to provide a smooth action jaw-type string release with a reduced cost of manufacture without sacrificing any of the functional performance requirements now demanded by archers. In addition, there remains a need for a dual action trigger, permitting the archer to fire either by pressing or releasing forward or squeezing rearward, as desired or as dictated by circumstances. It remains desirable to provide a jaw mechanism which, when opened, permits more readily loading of the string into the release notches, without sacrificing any of the locking features of the jaw or without greatly increasing the distance of travel between the opened and closed positions. In addition, it is desirable to provide a means for predictable, calibrated adjustment of the trigger force, to individual touch.

SUMMARY OF THE INVENTION

The subject invention is specifically directed to a bow string release having a trigger mechanism which is adapted for firing both in a forward and a reverse direction, simply as a matter of choice. Specifically, a contoured guide path such as a controlled guide slot is provided in the base of the trigger mechanism. The trigger is a center fire mechanism, wherein the center fire position may be engaged from either side, both of which define independent closed positions for retaining the string. When the trigger is pressed or released forward, it moves off a first locked idle position and releases the sear mechanism. Likewise when the trigger is pulled rearward, it releases the trigger from the second locked position and releases the sear. The preferred embodiment of the invention includes a lock-out feature to assure that the trigger is not inadvertently moved in the wrong direction, prematurely releasing the string and potentially prematurely releasing an arrow, the guide path for the trigger mechanism is specifically designed to normally operate in the pull to release, forward to lock motion. Thus, when the trigger is pulled back for loading, it automatically stops at the center position. Then, when it is moved forward, the sear is locked. If the archer decides or prefers to squeeze or move the trigger in a rearward direction in order to lock the release for retaining the string, it is first required that he push the trigger downward from its center position to close the notches for holding the string. Thus, as he loads the string and arrow in the sear mechanism, if he does not push the trigger downward, the trigger will operate in the forward to lock motion.

If the trigger is pushed downward during the loading operation, the trigger will then only operate when squeezed rearwardly. This feature assures against release the trigger when moving from the released position to the locked positions. Of course, this press to load feature may be replaced by a guide slot similar to the forward to lock motion allowing the release to be locked without pressing, if desired.

It is another feature of the subject-invention that the jaw mechanism has been reconfigured to permit elimination of the bearing element required between the pivotal jaws of the prior art. Specifically, an integral arcuate bearing surface is provided on one of the jaws and is adapted to be received in a mated arcuate bearing recess provided in the second jaw, assuring a smooth action of the jaw without requiring a separate bearing element. Since the jaws can be manufactured as a unitary element, this greatly reduces the cost of manufacture without sacrificing quality of the release mechanism. Also, to reduce the effect of wear and tear on the jaw mechanism, a pair of unique guide pins and sockets are provided forward of the bearing surface, to assure that the jaws always close in the same position when pivoting between the open and closed positions. This also assures that the front forward surface of the string retaining notch properly closes, causing proper, smooth abutment between the two jaws, reducing wear and tear on the string and reducing relative movement between the jaws in the locked position.

Another important feature incorporated in the jaw reconfiguration of the subject-invention is the addition of a resilient pad between the jaws near the trigger mechanism end thereof. When the jaws move from the closed to the open position, they are sprung outwardly by the release of the string under tension. This causes the jaws to hit against one another, often causing an undesirable "clicking" noise. By placing a resilient, cushioning pad between the jaws near the rearward end thereof, the release mechanism of the subject invention becomes virtually noiseless.

In order to facilitate reloading of the jaw, the forward end of the jaws have been reconfigured to provide a wider opening for receiving the string. Specifically, the outer tips of the jaws have been opened to provide an enlarged "V" opening for receiving the string. When the jaws are in the open position after firing, the open outer end of the jaws are approximately double the open width of prior art jaws, greatly facilitating entry of the string for reloading.

An additional feature of the preferred embodiment is provided in the unique manner in which the trigger force adjustment for a rearward motion to release type trigger mechanism. It is to be understood that this same adjustment mechanism can also be applied to the forward to lock trigger position, where desired. In the preferred embodiment, a set screw is positioned orthogonal to the motion of trigger travel, unlike in the prior art, where such screws are generally in longitudinal alignment with trigger control mechanism. By providing a conical or tapered surface which intersects the trigger path at an oblique angle, the distance of travel may be adjusted simply by turning the screw along is axis. This has several advantages over prior art adjustment mechanisms. First, this permits adjustment of the trigger at the trigger base, permitting ready access to the adjustment mechanism in the locked position. Secondly, by placing the movement of adjustment in a position orthogonal to the direction of trigger travel, the adjustment is more permanent in that repeated use of the trigger does not have a tendency to cause the adjustment to back off or creep from repeated use. Additionally, the trigger sear members may be shaped in such a way as to provide an adjustable range where a fixed proportional change in the adjustment screw results in a directly proportional change in the trigger pull force. If so desired, these members can be shaped to provide larger adjustment changes at lower trigger pull settings for very fine control.

It is, therefore, an object and feature of the subject invention to provide for an improved bow string release mechanism having a reversible trigger and a modified and simplified wrist strap attachment.

It is another object and feature of the subject invention to provide a bow string release with a trigger mechanism which is operable either in a rearward or a forward release motion.

It is a further object and feature of the subject invention to provide a beard protector for assuring that the beard of the archer does not catch in the mechanism when the bow is fully drawn with the hand pulled back to the chin and jaw area.

It is a further object and feature of the subject invention to provide a separate, tighter jaw locking means to reduce relative jaw movement, protecting against string wear and premature fire at low trigger force settings.

It is yet another object and feature of the subject invention to provide an improved jaw tip, facilitating entry of the string into the string retaining notches during reloading.

It is an additional object and feature of the invention to provide automatic latching of the release onto the bowstring upon entry of the bowstring into the sear mechanism.

Other objects and features of the invention will be readily apparent from the accompanying drawings and detailed description.

DETAILED DESCRIPTION OF THE PREFERRED EMBODIMENT

The release mechanism of the preferred embodiment of the subject invention is specifically shown in FIGS. 1–4.

Figure 1:
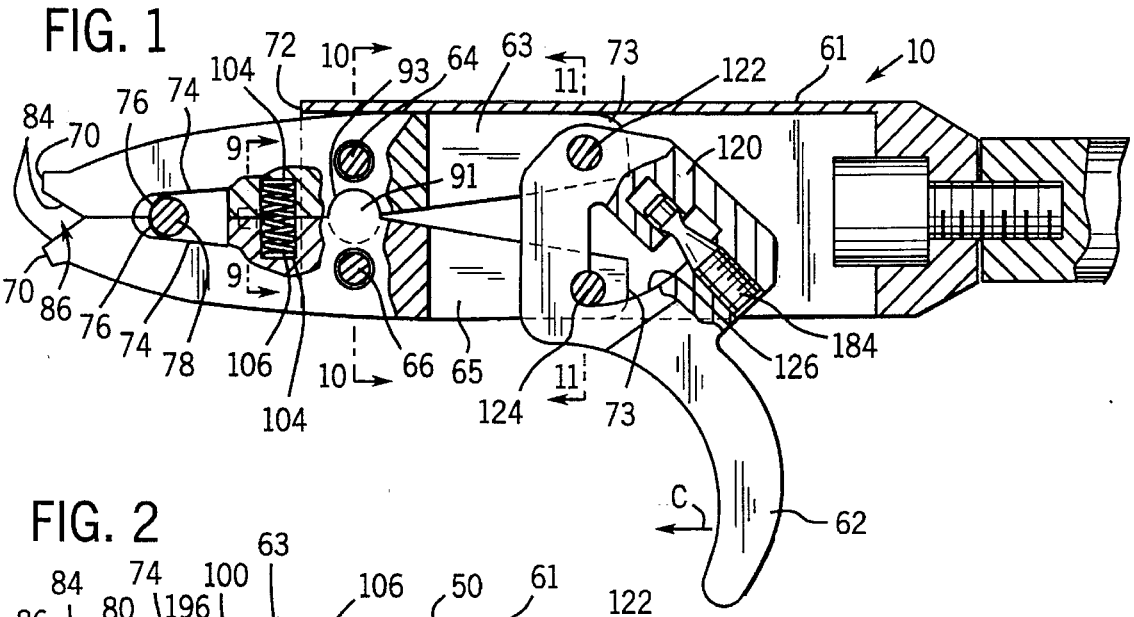
FIG. 1 is a longitudinal sectional view of the release of the subject invention, showing the trigger mechanism cocked for a forward fire operation.

With specific reference to FIG. 1, the release mechanism 10 includes a body 61 for housing a sear mechanism comprising a pair of jaws 63 and 65 controlled by the actuator trigger mechanism 62. In the preferred embodiment, both jaws 63 and 65 are mounted for pivotal movement relative to the housing at pivot points 64 and 66, respectfully. However, it will be readily understood that the jaw mechanism and trigger mechanism of the subject invention could be adapted to a single pivotal jaw configuration without departing from the scope and spirit of the subject invention.

In the preferred embodiment, each jaw comprises an elongated member having an outer tip 70 which projects outwardly from the forward open end 72 of the body 61. Approximately mid-way between the outer end 70 and the inner or rearward end :13 of each jaw is a pivot point, upon which each jaw is mounted on a pivot pin 64, 66 provided in the body 61. Slightly rearwardly of the outer tip end 70 of each jaw is a string retaining notch 74. When the jaws are in the closed position shown in FIGS. 1 and 3, the radial front surface 76 of each notch 74 is configured to conform to the periphery of the bow string 78. As is particularly shown in FIG. 2, the surface 80 of each jaw is also convex contoured to accommodate the position of the string when the bow is at maximum pull. This assures that no portion of the bow string is engaged by a sharp corner or sharp surface when the release of the subject invention is utilized. It is an important feature of the subject invention that the outer tip 70 of each jaw has been modified to include a tapered surface 84 providing a wide "V" opening 86 in the jaw mechanism. The wide "V" opening 86 presents a substantially wider mouth, as particularly shown in FIGS. 1 and 2, greatly facilitating replacement of the bow string 78 in the sear mechanism when reloading, without compromising the shape of the string retaining notches 74 or the contours 76 and 80 of the forward surface of each notch.

Figure 2:
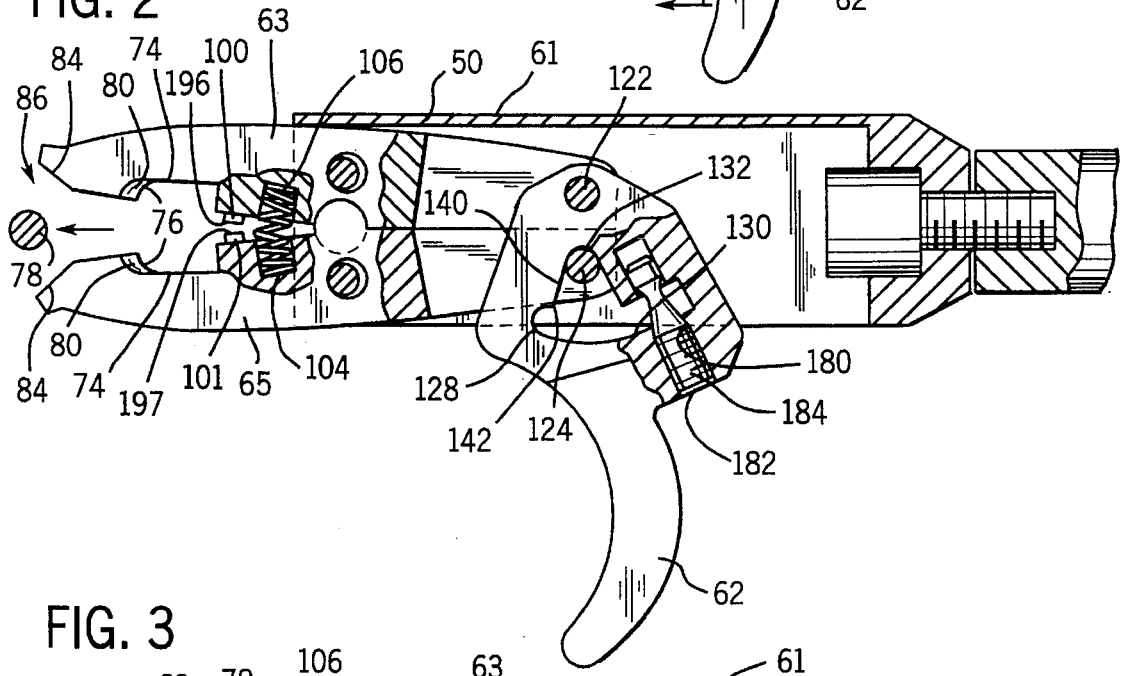
FIG. 2 is a view similar to FIG. 1, showing the release as fired from the position of FIG. 1, opening the sear mechanism for releasing the bow string.
Figure 10:
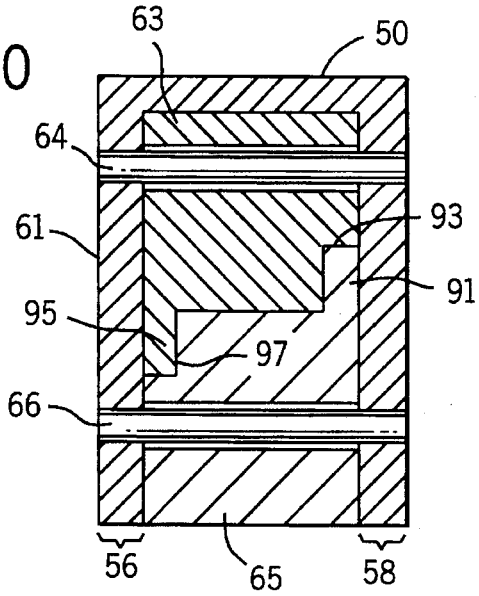
FIG. 10 is a sectional view taken along the line 10—10 of FIG. 1.

It is also an important feature of the subject invention that the heretofore required independent bearing element has been eliminated. In the preferred embodiment of the subject invention, an integral arcuate tab 91 is provided on one of the jaws 63 (see FIG. 10). A recessed, mated arcuate bearing seat 93 is provided on the mated complimentary jaw 65. As is best shown in FIG. 10, the tab 91 extends outwardly from the jaw 65 and is received in the mated seat 93 provided in the jaw 63. As is shown in FIGS. 1 and 2, the outer surface of the tab and the seat arcuate for providing a sliding bearing surface permitting the jaw to pivot open and closed. In the preferred embodiment a second tab 95 is provided on the bottom surface of the jaw 63 and extends outwardly and is received in a mated arcuate seat 97 provided in the jaw 65. The tabs 91 and 95 and seats 93 and 97 eliminate the need for the separate spherical bearing element used in many prior art configurations. In addition, the dual tab mechanism of the subject invention actually enhances the working function of the jaw by assuring that the jaws are locked in relative spacial relationship as they pivot, further assuring proper seating of the notches 74 as they retain the string and also providing a tighter fit while at the same time reducing dependence on machining and manufacturing tolerances.

Figure 8:
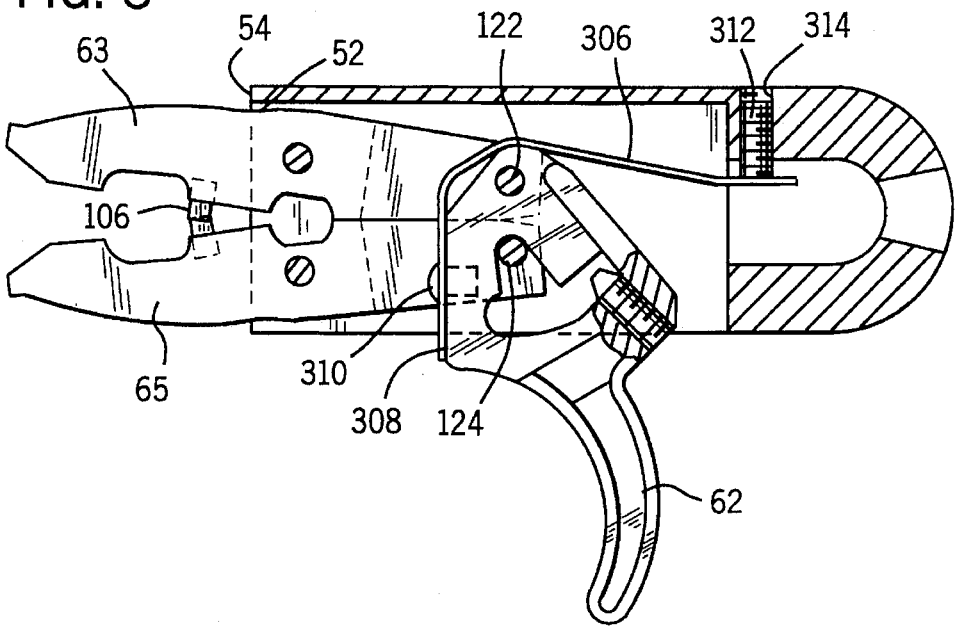
FIG. 8 is a view of the release of FIG. 7, corresponding to the view of FIG. 2.
Figure 9:
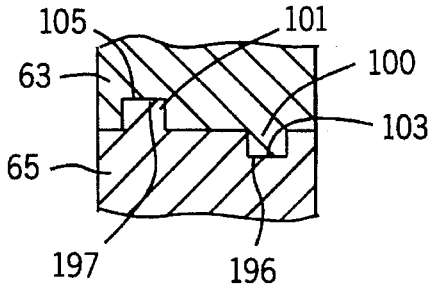
FIG. 9 is a sectional view taken along the line 9—9 of FIG. 1.

To further assure proper opening and closing action of the jaws, the subject invention includes a unique nesting pin arrangement (also see FIG. 9). The forward end of the jaws 63 and 65 between the pivot points 64, 66 and the string retaining notches 74, includes a unique pin and socket arrangement for seating or nesting the jaws when they are in their closed position. As best shown in FIGS. 1, 2 and 9, each jaw 63, 65 includes and outwardly projecting pin 100, 101, respectively. Jaw 65 also includes a mated socket 103 for receiving pin 100, whereas jaw 63 includes a mated socket 105 for receiving pin 104. This assures proper seating of the jaws when they are moved into the closed position, and accommodates for any wear and tear on the jaw mechanism from repeated use, which, due to relative movement between the jaws, can prematurely open the release. This further results in assuring that the forward ends 76 of the string retaining notch are properly aligned to reduce wear and tear on the bow string 78. In the embodiment of FIGS. 1–4, the outer ends 196 and 197 of pins 100, 101, respectively, are positioned such that the string 78 cannot pass through the gap even when the jaws are fully opened, as in FIG. 2. This assures that the string does not inadvertently pass through the notch area 74. In the embodiments of FIGS. 5–8, the ends 196 and 197 actually overlap (see particularly FIGS. 6 and 8). As the string 78 enters the notch area 74 (see FIG. 6) it will engage the pins 100, 101 and force the jaws together to the position of FIG. 5. The trigger mechanism will then move to the locked closed position, holding the string in the notch. This provides an automatically closing feature without the requirement of additional structure.

Figure 4:
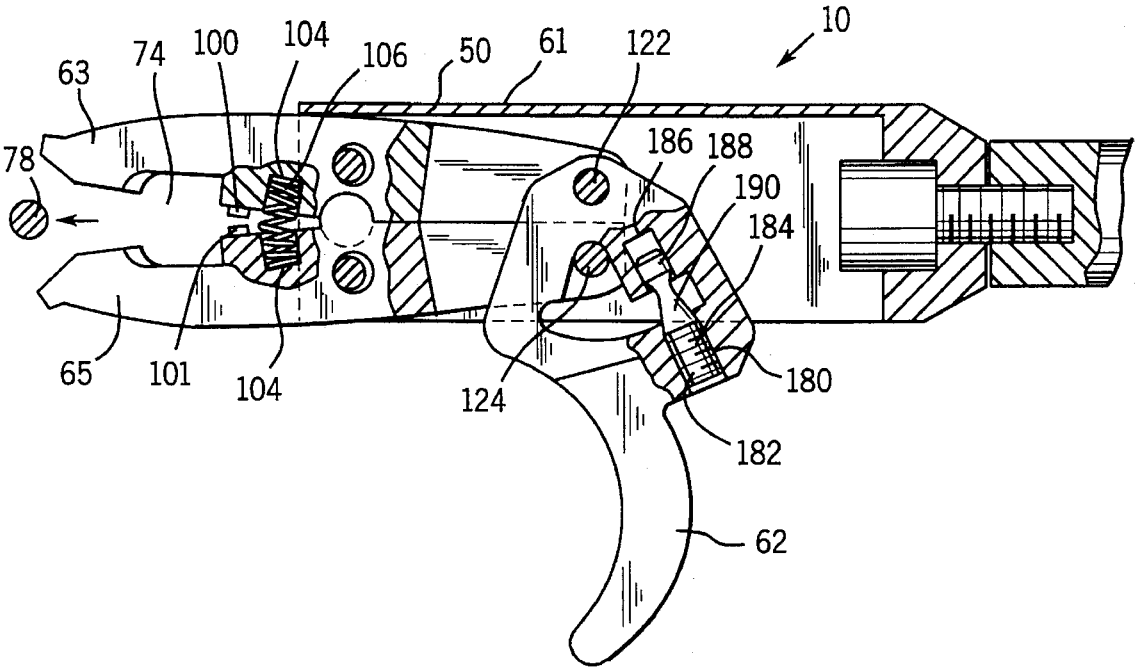
FIG. 4 is similar to FIG. 2, and shows the release as opened after fire from the cocked position of FIG. 3.

As is typical in jaw type releases, a seat 104 is provided in each jaw for receiving a compression member such as the spring 106, for normally biasing the release mechanism into the open position of FIGS. 2 and 4.

It is an important feature of the subject invention that the trigger mechanism 62 is operable in both a forward and reverse motion. As is specifically shown in FIGS. 1 and 2, the trigger mechanism 62 may be locked in a closed position for retaining the string 78, by pulling the trigger rearward, to the position of FIG. 1, and releasing it forward in the motion of arrow C, as shown in FIGS. 1 and 2. Specifically, the trigger 62 includes a base member 120 which is pivotally mounted on one of the jaws 63 as shown at 122. The second jaw 65 includes a guide post 124 which is adapted to be received in a contoured guide path or slot 126. In the preferred embodiment, the slot is generally "T" shaped with a forward extending outer reach 128 and a rearwardly extending outer reach 130, as is best shown in FIGS. 2 and 4. The base 132 of the "T" extends from the outer reaches 128 and 130 toward the pivot point 122. In the preferred embodiment, the base of the guide path 126 is tapered and is wider at the junction with the outer reaches than it is at its inner tip, for producing a smooth acting trigger motion.

As is specifically shown in FIGS. 2 and 4, the sear mechanism is opened for spreading the notches 74 when the guide pin 124 is positioned at the base 132 of the guide slot. When a string is positioned in the notches 74 of the opened release shown in FIG. 2, the trigger may then be pulled rearwardly, forcing the guide pin 124 to ride along the surface 140 of the base 132 and into the outer reach 128 of the slot, as shown in FIG. 1, for locking the string 78 in the closed notches 74. Upon forward motion of the trigger 62 in the direction of the arrow C (FIG. 1), the base 120 of the trigger is moved so that the guide pin 124 passes over the path junction 142 between the outer reach 128 and the base 132, permitting the guide pin to slide back down the surface 140 of the guide path, causing the notches 74 to spread apart for releasing the string 78. In the preferred embodiment surface 140 is not a ramp so to force conscious selection to engage the trigger in the locked position of FIG. 1. It is, therefore, necessary to push down (toward pivot 122) on the trigger, forcing jaw 63 toward the wall of the body 61, and permitting the guide pin 124 to move over the corner 142 of the guide path. This permits the guide pin to slide into the forwardly extending outer reach 128 of the guide slot 126, permitting the jaws to close in the manner shown in FIG. 2.

Figure 3:
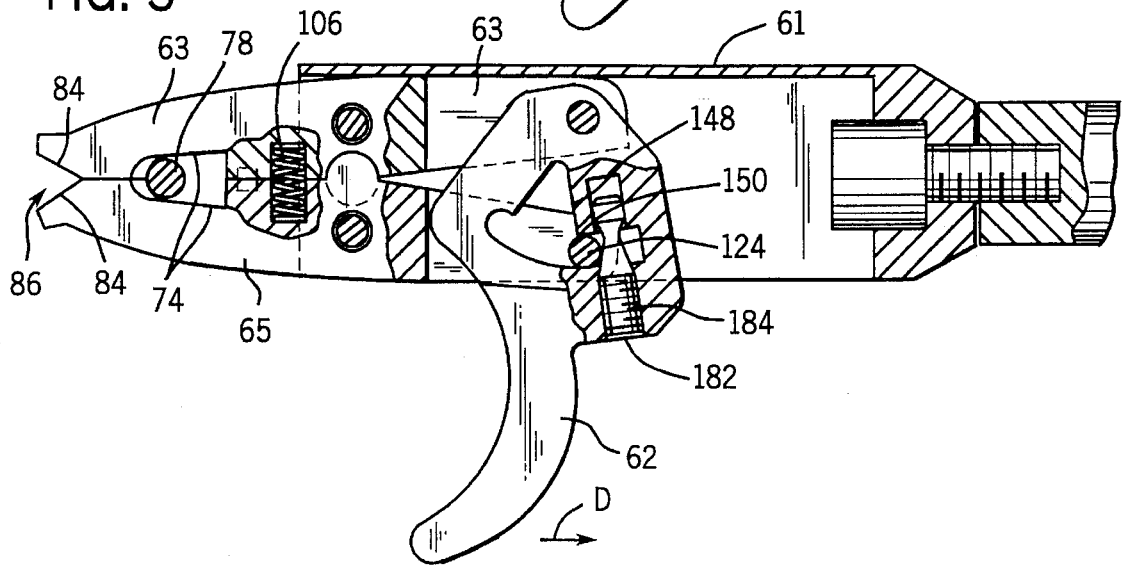
FIG. 3 is a view similar to FIG. 1, showing the release mechanism with the trigger cocked for a reverse fire motion.

As is shown in FIGS. 3 and 4, the trigger mechanism 62 of the subject invention is also adapted for use in a forward locked trigger fashion, wherein the trigger is moved rearward in the direction of the arrow D (FIG. 3) in order to release the string 78. Specifically, the release is initially open as shown in FIGS. 2 and 4. Once the string 78 is inserted between the notches 74 of the jaws 63 and 65, the release may be closed by pushing the trigger forward. This permits the guide pin 124 to ride along the rear surface 148 guide path base 132 and to the junction point 150. In order to release the jaw, the trigger 62 is moved rearwardly in the direction of arrow D, permitting the guide pin 124 to move past the corner 150 of the base into the slot and along the rear wall 148 of the slot into the base 132, for spreading the jaws apart and releasing the string.

It is often desirable to adjust the "pull" force required to operate the trigger. In the preferred embodiment, as is shown in FIGS. 1–4, the base 120 of the trigger 62 includes an elongated aperture or channel 180 extending downwardly through and intersecting the rearwardly extending outer reach 130 of the guide path. The outer end 182 of the channel 180 is tapped and adapted for receiving a threaded shaft such as the set screw 184. The set screw 184 extends through the reach 130 and into the lower or inner end 186 of the channel 180. A bearing surface 188 is provided on the inner end of the set screw 184. The portion 190 of the set screw which intersects the reach 130 of the guide path is tapered to provide a surface which intersects the reach 130 at an oblique angle. This permits the set screw to be turned and moved axially along its path in the channel 180 while adjusting the lengths of the reach 130 for providing a positive stop for the guide pin 124, as is specifically shown in FIG. 3.

By turning the screw 184 inwardly or outwardly in the channel 180, it can be seen that the positive stop for the guide 124 is adjusted along the tapered surface 190 of the set screw for adjusting the "pull" of the trigger 62. This assures that the adjustment of the reach length is provided in a direction substantially orthogonal to the primary trigger forces, providing a more accurate and more durable adjustment mechanism. Further, by utilizing the adjustment mechanism of the preferred embodiment, the screw head 192 is more readily accessed, being positioned just behind the trigger 62.

Additionally, the tapered set screw in combination with the specially profiled surface at point 150 results in an adjustment means that is in terms of incremental rotation of the screw, directly proportional to the force required to operate the trigger. It is to be readily understood that by changing the profile at point 150 or changing the taper on the adjustment screw the adjustment can be completely or partially proportional throughout the entire adjustment range. The adjustment at lower trigger pull settings if so desired, can require more adjustment input then is required at higher trigger pull settings resulting in a very precisely adjustable trigger at low trigger pull settings. The specially profiled surface at point 150 and the tapered set screw together or separately enable release adjustment in a manner not possible in any current release.

Figure 5:
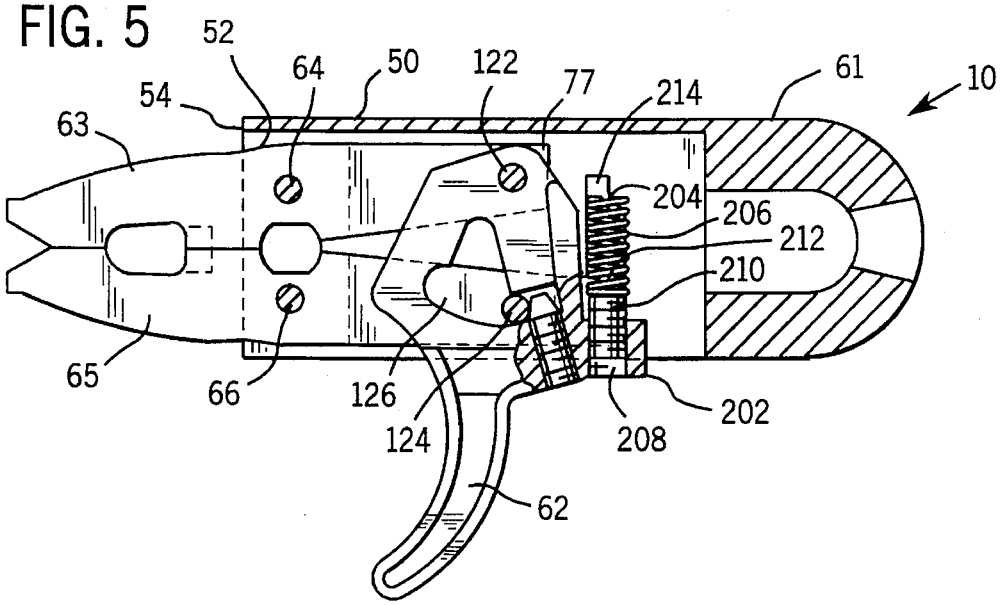
FIG. 5 is a view similar to FIG. 1, showing an alternative embodiment of the release.
Figure 6:
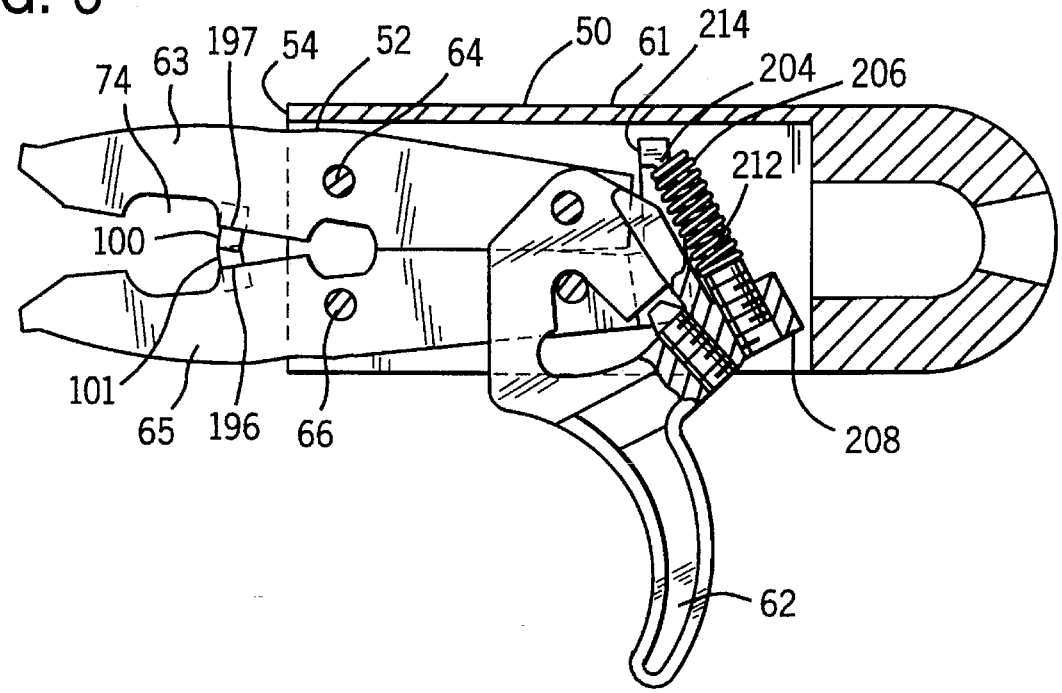
FIG. 6 is a view of the release of FIG. 5, corresponding to the view of FIG. 2.

A first alternative embodiment of the release mechanism of the subject invention is shown in FIGS. 5 and 6. As there shown, the biasing spring 106 which located between release jaws 63 and 65 (see FIG. 4) has been replaced by the coil compression spring 206, positioned between the trigger and release body. Specifically, the trigger mechanism includes an extension 208 forming a first spring seat on trigger 62. In the preferred embodiment, the spring seat includes a tapped hole for receiving a threaded adjustment screw 210. The outer tip 212 of the adjusting screw receives and seats one end of the spring 206.

The lower jaw 65 is modified to include an extension 214 for receiving and seating the opposite end of the spring 206. As can be best seen in FIG. 6, when the release is in the open position, the spring 206 will push the trigger downward moving jaw 63 and the extension 214 of jaw 65 upward, causing jaw 63 and jaw 65 to rotate about the pivots 64 and 66, respectively, urging the jaws into the open position. The screw 210 permits the amount of force applied by the spring to be adjusted and calibrated to individual feel.

A second alternative embodiment of the release is shown in FIG. 8, wherein the biasing element comprises a leaf or wire type spring 306 mounted directly on the front wall 308 of the trigger mechanism by means, such as by way of example, the mounting screw 310. The opposite end of the spring is seated against an adjusting screw 312 which is adjustably carried in a receptive hole 314 provided in the body of the release. As in the embodiment of FIGS. 5 and 6, the release is biased into the open position by the spring 306.

Figure 7:
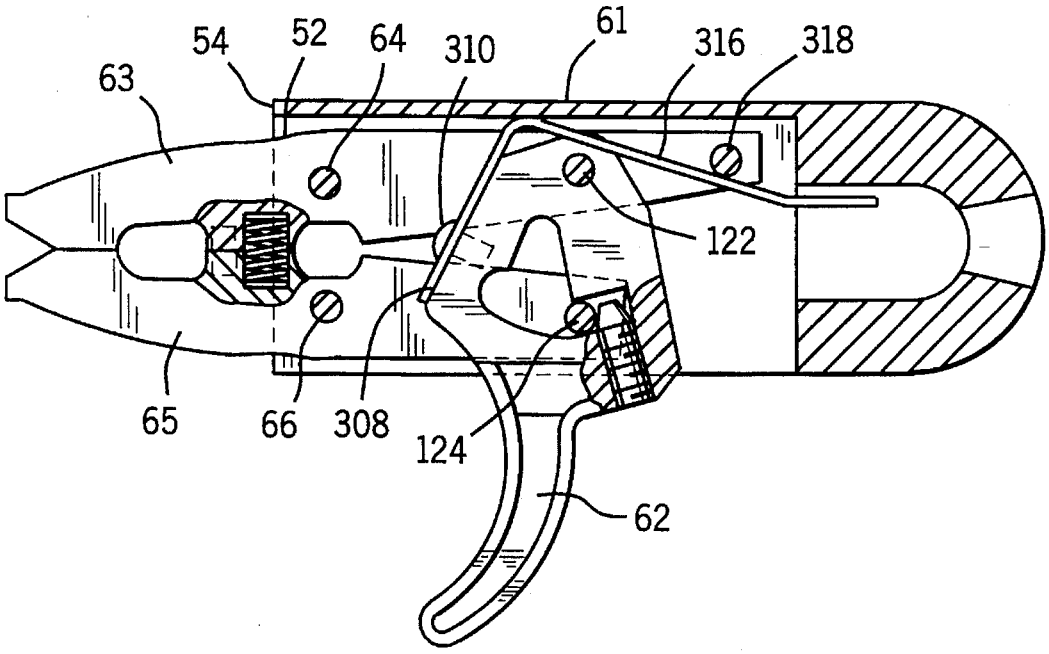
FIG. 7 is a view similar to FIG. 1, showing a second alternative embodiment of the release.

A third embodiment of the release is shown in FIG. 7, wherein the biasing element comprises a leaf or wire type spring 406 mounted directly on the front wall 308 of the trigger mechanism by means such as by way of example the screw 310. The opposite end of the spring 316 is seated against pin 318 in jaw 63 causing trigger 62 to rotate about point 122. Spring 106 biases the jaws in an open position, and spring 316 causes the trigger 62 to latch in a closed position when jaws 63 and 65 are closed.

Figure 11:
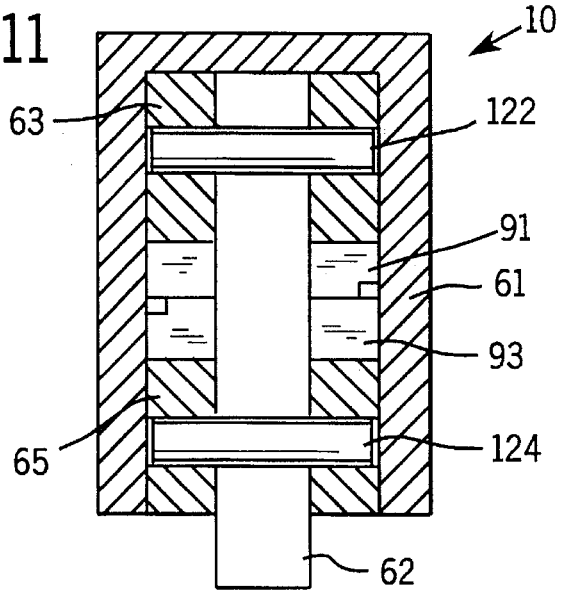
FIG. 11 is a sectional view taken along the line 11—11 of FIG. 1.
Figure 12:
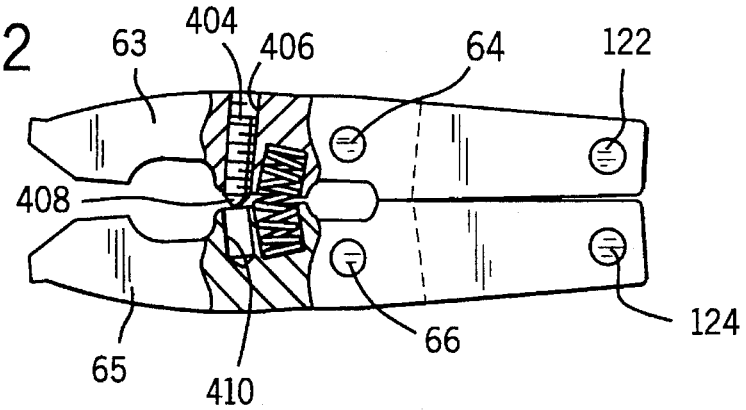
FIG. 12 is a fragmentary view looking in the same direction as FIG. 6, illustrating an alternative embodiment of the locking pins.
Figure 13:
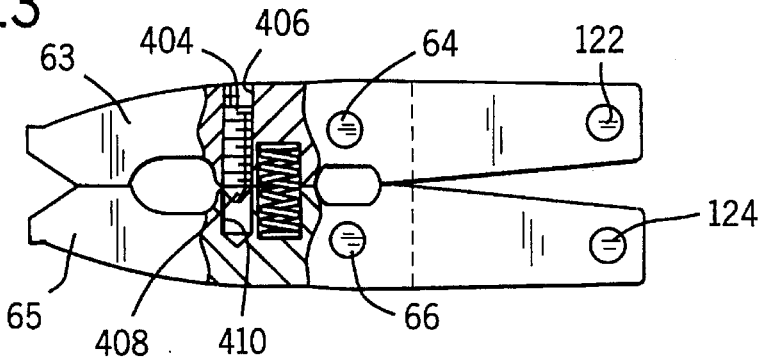
FIG. 13 is a fragmentary view of the embodiment of FIG. 12 and looking in the same direction as FIG. 5.

An alternative embodiment of the pin and socket arrangement is shown in FIGS. 11 and 12. As there shown, each projecting pin 104 is replaced by a threaded element 404 which is received in a through tapped hole 406 in the respective jaw. The outer end 408 of the element 404 comprises a nesting pin tip corresponding to the pin 104. A complementary mated socket 410 is provided in the opposite jaw and is adapted for receiving and nesting the pin tip 408 when the jaws are closed as in FIG. 12. This construction permits adjustment of the nesting mechanism, greatly enhancing manufacturing flexibility, and enhancing the complete closure characteristics of the jaws when in the nested position.

The design of the subject invention also includes a novel feature for protecting the beard of an archer. Typically, when the bow is drawn the archer places his eye along the shaft of the arrow, with his hand against his cheek or jaw. When the archer is bearded, the release mechanism can get caught in the beard. In the preferred embodiment, when the release is fired as shown in FIGS. 5 or 6 the guard 50 is in position above the jaw 63 to keep the archer's beard or hair out of the jaw and trigger mechanism. The jaw 63 is profiled in area 52 such that whether in the fully open or fully closed position, or intermediately of either, the distance between the jaw 63 and the guard 50 at point 54 is constant. This feature reduces the gap require at point 54 between the jaw 63 and the guard 50 and eliminates the pinching effect that a reduction of the gap during firing would have, possibly catching any hair in the gap area. In the preferred embodiment the guard 50 is part of the release body 61, enabling the body to be thinner at areas 56 and 58 of FIG. 10. The body 61 is reinforced by the guard 50 so that it is just as strong as prior art designs with similar overall dimensions, but the thickness at areas 56 and 58 allow jaws 63 and 65 to be wider, reducing string wear by spreading the forces over a larger area. It should be understood that this feature also would allow the jaws to be of the same dimensions as the prior art, permitting the release to be reduced in overall size.

While the preferred embodiment of the subject invention includes a plurality of unique features which may be used either in combination with one another or independently with other bow string release mechanisms, it will be readily understood that the various features of the invention both independently and in combination greatly enhance the function, durability and manufacturability of a bow string release mechanism. Thus while specific features and embodiments of the invention have been described in detail herein, it will be readily understood that the invention encompasses all modifications and enhancements within the scope and spirit of the following claims.

What is claimed is:

1. A bow string release having a body, a movable jaw mechanism within the body, the jaw mechanism including means for engaging a bow string when in a first position and for releasing the bow string when in a second position, and a trigger for controlling the jaw mechanism, the release further comprising a guard adjacent the jaw mechanism for minimizing the entry of hair into the jaw mechanism, the guard positioned for defining a gap between the guard and the jaw mechanism, regardless of the position of the movable jaw mechanism.

2. The bow string release of claim 1, the guard comprising an integral part of the body.

3. The bow string release of claim 1, wherein the means for engaging is contoured such that the gap is constant regardless of jaw mechanism position.

* * * * *